US012709827B2

(12) United States Patent
Zavala

(10) Patent No.: US 12,709,827 B2
(45) Date of Patent: Aug. 18, 2026

(54) ARTICLE OF FOOTWEAR WITH A KNITTED COMPONENT

(71) Applicant: NIKE, Inc., Beaverton, OR (US)

(72) Inventor: Roberto Zavala, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 18/968,028

(22) Filed: Dec. 4, 2024

(65) Prior Publication Data

US 2025/0185751 A1 Jun. 12, 2025

Related U.S. Application Data

(60) Provisional application No. 63/608,982, filed on Dec. 12, 2023.

(51) Int. Cl.

| | |
|---|---|
| ***D04B 1/24*** | (2006.01) |
| ***A43B 1/04*** | (2022.01) |
| ***A43B 23/02*** | (2006.01) |

(52) U.S. Cl.

CPC ..... *D04B 1/24* (2013.01); *A43B 1/04* (2013.01); *A43B 23/0245* (2013.01); *D10B 2501/043* (2013.01)

(58) Field of Classification Search

CPC ..... D04B 1/24; D04B 21/10; D04B 21/20; A43B 1/04; A43B 23/0245

See application file for complete search history.

(56) References Cited

U.S. PATENT DOCUMENTS

| | | | | |
|---|---|---|---|---|
| 4,267,710 | A | 5/1981 | Imamichi | |
| 5,385,036 | A * | 1/1995 | Spillane | A43B 1/04 66/196 |
| 6,630,414 | B1 * | 10/2003 | Matsumoto | A47C 31/006 428/116 |
| 7,235,504 | B2 * | 6/2007 | Shirasaki | A47C 31/006 66/196 |
| 10,597,805 | B2 * | 3/2020 | Takahashi | D04B 21/10 |
| 12,252,819 | B2 * | 3/2025 | Cox | D04B 1/24 |
| 2012/0233882 | A1 | 9/2012 | Huffa et al. | |

(Continued)

FOREIGN PATENT DOCUMENTS

WO WO-2025128550 A1 * 6/2025 ..... D04B 1/104

OTHER PUBLICATIONS

International Search Report and Written Opinion received for PCT Patent Application No. PCT/US2024/059351, mailed on May 26, 2025, 19 pages.

(Continued)

*Primary Examiner* — Danny Worrell
(74) *Attorney, Agent, or Firm* — SHOOK, HARDY & BACON L.L.P.

(57) ABSTRACT

Aspects herein are directed to, among other things, a knitted component for an article of footwear. The knitted component includes a first knit layer having openings exposing portions of a second knit layer. The first and second knit layers may have different yarn with different properties, such as different colors. On at least one side of the opening, the first knit layer may overlay and be separable from the second knit layer such that a pocket is formed, which may extend continuously into the opening. Stretching the knitted component may expose additional portions of the second knit layer through the openings.

21 Claims, 6 Drawing Sheets

(56) References Cited

U.S. PATENT DOCUMENTS

| | | | | |
|---|---|---|---|---|
| 2015/0059209 | A1 | 3/2015 | Dekovic et al. | |
| 2019/0223540 | A1* | 7/2019 | Cox | A43B 1/04 |
| 2019/0368087 | A1* | 12/2019 | Boylu | D04B 1/24 |
| 2020/0121019 | A1* | 4/2020 | Bartys | D04B 1/24 |
| 2022/0282409 | A1* | 9/2022 | Hendry | D04B 1/126 |
| 2022/0339904 | A1* | 10/2022 | Amin | D04B 1/246 |
| 2025/0185751 | A1* | 6/2025 | Zavala | A43B 23/0245 |

OTHER PUBLICATIONS

Invitation to Pay Additional Fees received for PCT Patent Application No. PCT/US2024/059351, mailed on Mar. 24, 2025, 12 pages.

* cited by examiner

ARTICLE OF FOOTWEAR WITH A KNITTED COMPONENT

CROSS-REFERENCE TO RELATED APPLICATIONS

This patent application claims the benefit of U.S. Prov. Appl. No. 63/608,982, entitled "ARTICLE OF FOOTWEAR WITH A KNITTED COMPONENT," filed Dec. 12, 2023. The aforementioned application is incorporated herein by reference in its entirety.

BACKGROUND

Conventional articles of footwear generally include two primary elements: an upper and a sole structure. The upper is secured to the sole structure and forms a void within the footwear for comfortably and securely receiving a foot. Uppers may be formed by a variety of materials, including knitted textiles. Various knit structures and materials may impact the degree of stretch of which the upper is capable. Some stretch may be desirable for discrete activities, such as donning the upper. Other times, stretch may be desired over prolonged times, such as to accommodate changes in the size of a wearer's foot. For example, a particular medical or health condition, such as pregnancy, may cause swelling or other changes in the size of a wearer's foot.

BRIEF DESCRIPTION OF THE DRAWINGS

Examples of aspects herein are described in detail below with reference to the attached drawing figures, wherein.

DETAILED DESCRIPTION

Figure 1A:
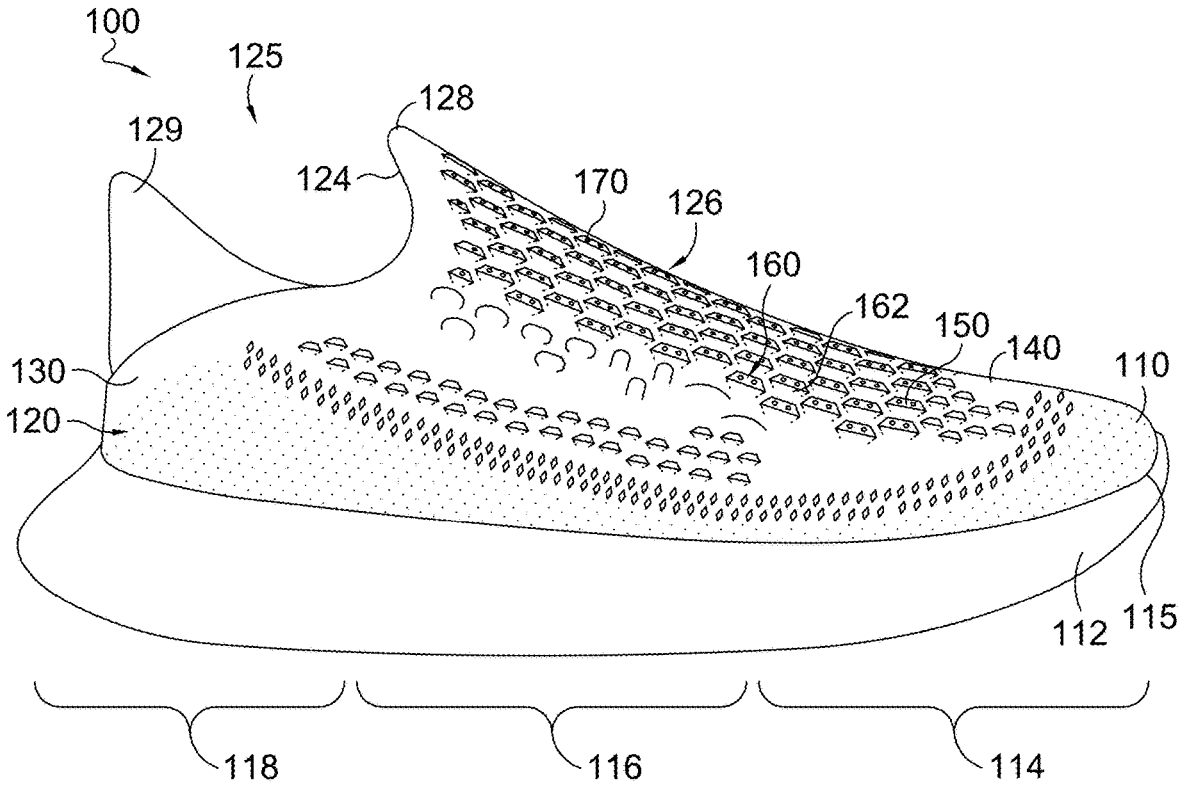
FIG. 1A illustrates a lateral view of an example article of footwear in accordance with aspects herein.

Aspects herein are directed to knitted components, articles of footwear having a knitted component, and methods of manufacturing a knitted component having a first knit layer and a second knit layer, where portions of the second knit layer are exposed through openings in the first knit layer. The first and second knit layers may be secured together in a way that enables stretch in a medial-to-lateral direction, which may be a wale-wise direction. Further, the first and second knit layers may each comprise yarn having a different visual property than yarn of the other layer, and the degree that one of the visual properties is apparent from external view may change as the knitted component stretches. For example, openings in the first knit layer may expose portions of the second knit layer, and stretching the knitted component may reveal additional portions of the second knit component, thereby increasing the amount of the yarn of the second knit layer that is visible.

As stated, the first knit layer may overlay portions of the second knit layer and have openings that expose other portions of the underlying second knit layer. The double knit construction may provide structure and body to an upper having the knitted component, while the openings in the first knit layer may increase the ability of the knitted component to stretch. Further, where the first knit layer overlays and is separable from the second knit layer, a pocket is formed between the two layers. The first and second knit layers may be integrally joined along one side of the pocket but unsecured on another side, such that the first knit layer forms a flap-like structure, and the pocket between the first and second knit layers may extend continually into the opening on at least one side. Because the flaps of the first knit layer are unsecured to the second knit layer at least on one side, the first knit layer may provide a lower resistance to stretch than if the flaps of the first knit layer were secured to the second knit layer on all sides.

Additionally, because the flaps of the first knit layer have a side that is unsecured to the second knit layer, stretching the knitted component can reveal additional portions of the second knit layer from underneath the flaps. As such, aspects of the first and second knit layers may have different visual properties such that revealing more of one of the layers may change the overall visual effect. For example, the first knit layer may comprise a first yarn with a first property, such as a first color, and the second knit layer may comprise a second yarn with a second property, such as a second color. When the knitted component moves from an un-stretched condition to a stretched condition, the amount of the second yarn from the second knit layer that is visible may increase as additional portions of the second knit layer are stretched from underneath the flap of the first knit layer. This change in visual effect may occur when portions of the knitted component become stretched for discrete periods of time due to certain actions or movement, such as donning the footwear and flexing or pointing the foot. However, it may also create a visual change as a wearer's foot size increases, such as what can occur during pregnancy.

Some aspects further include apertures extending completely through the knitted component to provide breathability. These apertures may be within the second knit layer and be positioned in portions of the second knit layer that are uncovered through the openings in the first knit layer.

Some aspects include a knitted component with integrally formed zones having structures disclosed herein with variations in size and/or features. For example, a first zone may include openings, as described further herein, in the first knit layer of a first size (e.g., width) and a first quantity of apertures, as described further herein, in the second knit layer per opening of the first knit layer, while a second zone may include openings of a second size and a second quantity of apertures per opening of the first knit layer. In some aspects, the first zone has openings of a greater width than the second zone and may be positioned over the throat region, where greater stretch may be desired. Additionally, the first zone may have one or more openings in the first knit layer that each surround one or more apertures (e.g., two apertures) in the second knit layer, while the second zone may have no apertures in the second knit layer within the openings of the first knit layer. As a result, the first zone, which may be in a throat region, may have increased breathability compared to other portions of the upper. A transition area may include openings in the first knit layer with an intermediate size between the first and second size and with an intermediate quantity of apertures in the second knit layer (e.g., one aperture) per opening.

As used herein, an article of footwear generally includes a sole structure secured to an upper. The article of footwear described herein may comprise a running shoe, a baseball shoe, a basketball shoe, a cycling shoe, an American football shoe, a tennis shoe, a global football shoe, a training shoe, a walking shoe, a hiking shoe, and the like. The concepts described herein may also be applied to other footwear types that are considered non-athletic such as dress shoes, loafers, sandals, and work boots. As used herein, the article of footwear may be divided into different general regions. A forefoot region generally includes portions of the article of footwear that correspond to the toes and joints connecting the metatarsals with the phalanges. A midfoot region generally includes portions of the article of footwear corresponding with an arch area and an instep area of the foot. A heel region generally corresponds with rear portions of the foot including the calcaneus bone. The article of footwear described herein may include a lateral side that corresponds with an outside area of the foot (i.e., the surface that faces away from the other foot) and a medial side that corresponds with an inside area of the foot (i.e., the surface that faces toward the other foot). The different regions and sides described above are intended to represent general areas of footwear to aid in the following discussion and are not intended to demarcate precise areas. The different regions and sides may be applied to the article of footwear as a whole, to the knitted upper, and to the sole structure.

The term "outer-facing surface" as used herein means a surface of the knitted upper or article of footwear that faces the external environment. In some aspects, the outer-facing surface may mean the outermost-facing surface of the knitted upper or article of footwear. The term "inner-facing surface" as used herein means a surface of the knitted upper or article of footwear that faces a void for receiving the wearer's foot. In some aspects, the inner-facing surface may mean the innermost-facing surface of the knitted upper or article of footwear.

The term "knit" such as is used herein to describe the knitted component refers to a textile piece that is formed from at least one yarn that is manipulated (e.g., with a knitting machine) to form a plurality of intermeshed loops (also known as interlooping) that define courses and wales. The term "course," as used herein, refers to a predominantly horizontal row of knit loops (in an upright textile as it is knit on the knitting machine) that is produced by adjacent needles during the same knitting cycle. The course may comprise one or more stitch types, such as a knit stitch, a missed stitch, a tuck stitch, a transfer stitch, a rib stitch, and the like, as these terms are known in the art of knitting. The term "course-wise direction" refers to a direction that is parallel to the knit courses of the textile piece. The term "wale," as used herein, is a predominantly vertical column of intermeshed or interlooped knit loops, generally produced by the same needle at successive (but not necessarily all) courses or knitting cycles. The term "wale-wise direction" refers to a direction that is parallel to the knit wales of the textile piece.

The term "integrally knit," as used herein, may mean a knit textile having a yarn from one or more knit courses in a first area being interlooped with one or more knit courses of another area. The interlooping may be through a simple knit stitch, a tuck stitch, a held stitch, a float or miss stitch, and the like. In this way, areas that are integrally knit together have a seamless transition such that they seamlessly extend from one another. In some cases, the term is used to describe two layers covering the same area, where those two layers are interconnected through a common yarn forming at least part of a course on one layer and moving to form part of a course on the other layer, a yarn extending between and forming at least some of each of the two layers, and/or yarns from each layer being formed using overlapping sets of needles on a needle bed at the same time such that the yarns of each layer may be intertwined even if they do not interloop one another. In these cases, the two layers are integrally knit in that they are connected at one or more locations through the knitted process and not through stitches, adhesive, or other bonding.

The term "double knit construction," as used herein, refers to a knit construction that is generally formed on at least two needle beds of a knitting machine (i.e., a multi-bed construction). Such multi-bed knit constructions may be characterized by two opposing faces or layers of knit loops and/or tucks, e.g., one face/layer of loops formed on a first needle bed (e.g., a first knit layer), and a second face/layer of loops formed on a second needle bed (e.g., a second knit layer). In example aspects, the two faces/layers may be joined by yarns that interloop with yarns in both the first face/layer and the second face/layer of the double knit construction (e.g., transfer yarns). However, aspects herein contemplate that the two faces/layers may not be joined such that a space or potential space is formed between the two faces/layers. The term "pocket," as used herein, refers to this space or potential space between two overlapping layers that are unsecured to one another in the area of the pocket. Common double knit constructions include double jersey, rib, interlock, cardigan, other "double bed" knit structures initially formed on at least two needle beds, and other knit structures having two opposing faces/layers of knit loops or tucks, including full-gauge and less-than-full gauge variations of those structures. The term "single knit construction" as used herein refers to a single-layer knit construction generally formed on a single needle bed (i.e., a single-bed construction). In some examples, a single knit construction may be formed on a multi-bed knitting machine by knitting a number of knit courses on a first needle bed of the knitting machine and then transferring all of the loops to a second needle bed of the knitting machine where a number of knit courses are then knit. This knitting sequence may be repeated any number of times, as is further described below. Common single knit constructions include single jersey. Some aspects disclosed herein include a knitted component with a double knit construction in one area that is integrally formed with a portion having a single knit construction.

The term "opening," as used herein, refers to an engineered opening in a first knit layer that exposes portions of the underlying knit structure. An opening referred to herein extends across a plurality of wales and, in some aspects, extends across a plurality of courses. The term "aperture" as used herein refers to an engineered opening in the second knit layer. Unlike an "opening," which reveals an underlying knit structure, an "aperture," as used herein, refers to an opening that extends from a first side to a second side of the knitted component. Particularly, even though the aperture may be in only the second knit layer, the aperture may be in the area of the second knit layer exposed through the opening of the first knit layer such that an aperture may effectively extend through the thickness of the knitted component. The terms "opening" and "aperture" as used herein refer to intentionally engineered openings and are not inherent spacing between any adjacent loops in a knit structure.

Forming an article, such as an upper, using a knit construction may provide advantages including, but not limited to, a particular degree of elasticity (for example, as expressed in terms of Young's modulus), breathability, bendability, strength, moisture absorption, weight, abrasion resistance, and/or a combination thereof. These characteristics may be accomplished by selecting a particular knit structure, by varying the size and tension of the knit structure, by using one or more yarns formed of a particular material (e.g., a relatively elastic material such as elasticated yarns, a thermoplastic material), by selecting yarns of a particular size (e.g., denier), and/or a combination thereof. Using a knit construction may also provide desirable aesthetic characteristics by incorporating yarns having different colors, textures, or other visual properties arranged in a particular pattern. The yarns themselves and/or the knit structure formed by one or more of the yarns may be varied at different locations such that the knitted upper may have different properties as described herein.

Unless indicated otherwise, all measurements provided herein are taken when the upper and/or article of footwear is at standard ambient temperature and pressure (298.15 K and 100 kPa) and is in a resting (non-tensioned) state. As used herein, the terms "substantially" and "about" mean within +5% of an indicated value.

Figure 1B:
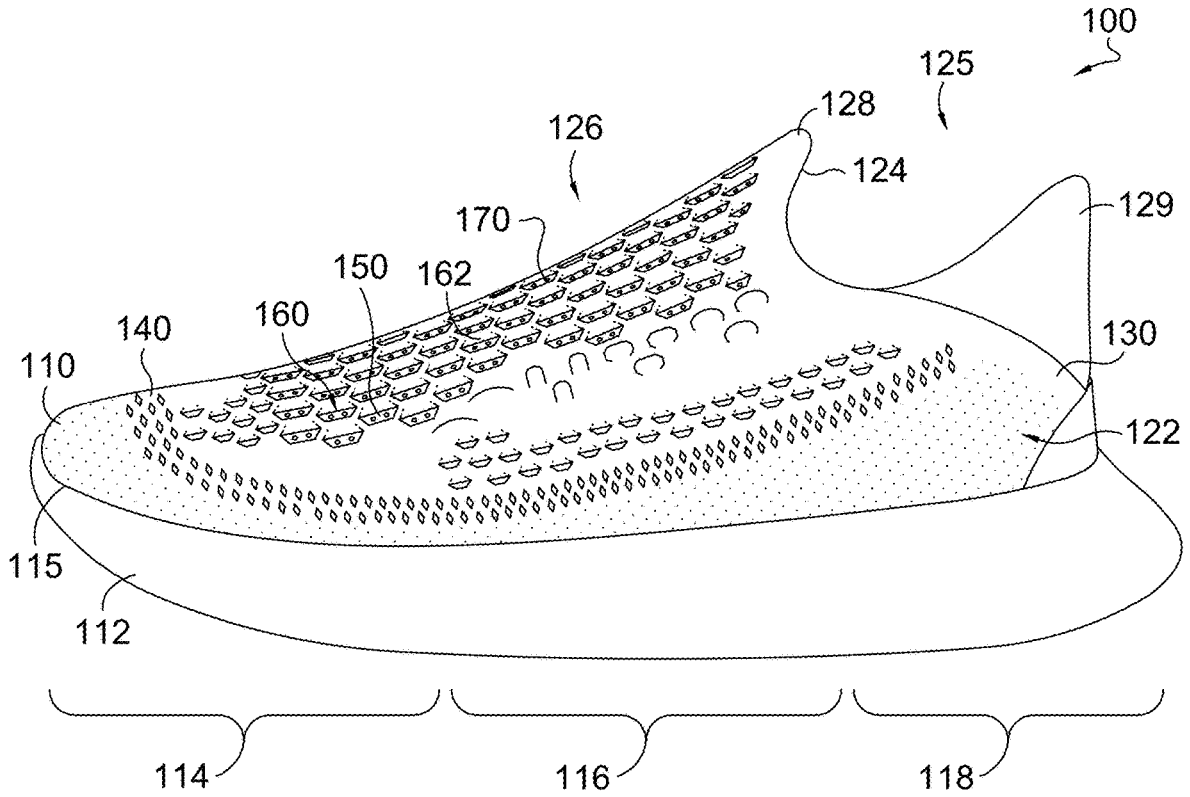
FIG. 1B illustrates a medial view of the example article of footwear of FIG. 1A in accordance with aspects herein.
Figure 1C:
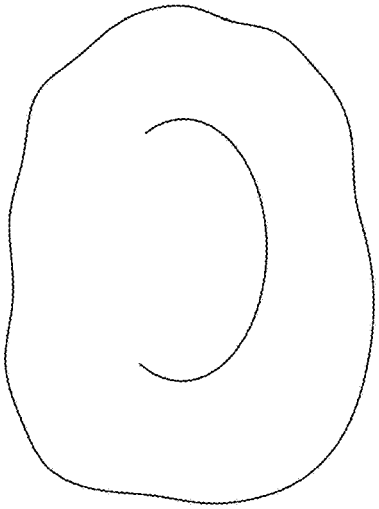
FIGS. 1C-1F illustrate close-up views of portions of a knitted component forming part of the article of footwear of FIG. 1A in accordance with aspects herein.
Figure 1D:
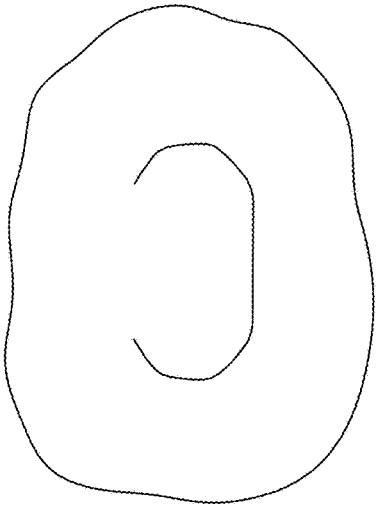
Figure 1E:
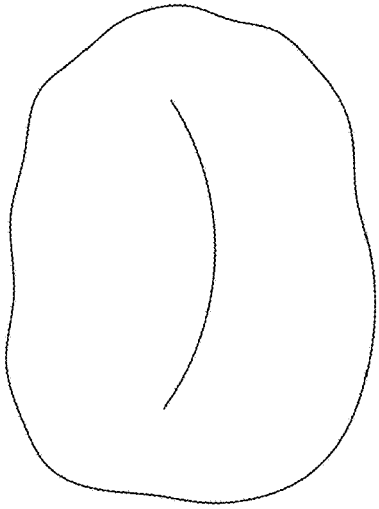
Figure 1F:
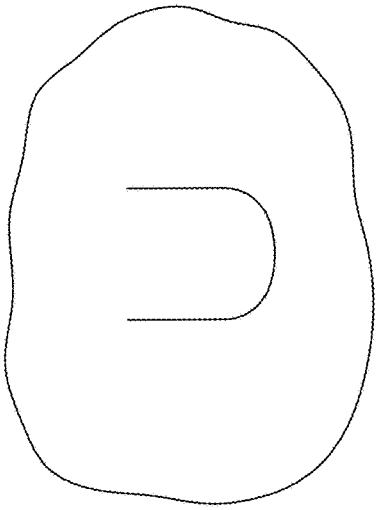

FIGS. 1A and 1B schematically depict a lateral view and a medial view, respectively, of an example article of footwear 100 having an upper 110 and a sole structure 112 secured to the upper 110. A biteline 115 represents where the upper 110 meets the sole structure 112. The article of footwear 100 is shown in the form of an athletic shoe, but other types of shoes (e.g., sandals, leisure shoes, and the like) are contemplated herein. The article of footwear 100 includes a forefoot region 114, a midfoot region 116, a heel region 118, a lateral side 120, and a medial side 122. The article of footwear 100 includes an ankle collar 124 having an opening 125 for receiving a wearer's foot and a throat region 126. Some aspects of the throat region 126 are continuous such that there is not a tongue structure separable from medial and lateral sides 122 and 120. Such aspects may include a tongue tab 128. Other aspects of the throat region 126 may include a separable tongue and/or one or more fasteners, such as laces.

In example aspects, the upper 110 includes a knitted component 130 that forms at least part of the upper 110. For example, the knitted component 130 may form at least part of the midfoot region 116 and at least part of the forefoot region 114 of the upper 110. The knitted component 130 may form all or some of the heel region 118. Aspects herein contemplate that the upper 110 may include one or more additional elements on top of or underneath the knitted component 130 including, for example, leather materials, synthetic leather materials, knitted or woven textiles, polymer skins, and the like. The additional elements may be positioned at discrete locations of the upper 110 including, for example, a toe area (e.g., a toe cap), the heel area (e.g., a heel counter), and the like. For example, aspects of the upper 110 may include a heel counter 129 that is separately formed and joined with the knitted component to form part of the heel region 118. The knitted component 130 may form all or substantially all of the upper 110 aside from additional pieces applied on top of or underneath the knitted component 130. In the example shown, the knitted component 130 forms the forefoot region 114, the midfoot region 116, and part of the heel region 118. The knitted component 130 includes a plurality of knit courses that, in some aspects, generally extend longitudinally in a toe-heel direction.

The knitted component 130 comprises one or more yarns that may include monofilaments yarns and/or multifilament yarns formed from, for example, synthetic materials or natural materials. In some aspects, the knitted component 130 includes elastane yarns. The knitted component 130 may include multiple elastane yarns, including elastane yarns with varying properties, and in some examples, where all or substantially all of the yarns knit into the knitted component 130 are elastane yarns. Such elastane yarns may be formed entirely of elastane. In other aspects, the elastane yarns of the knitted component 130 may include another material. For example, at least some yarns of the knitted component 130 may be elastane covered with polyethylene terephthalate (PET) (commonly referred to as polyester) or polyamide (commonly referred to as nylon).

The knitted component 130 includes a first knit layer 140 and a second knit layer 150. The first knit layer 140 at least partially overlays the second knit layer 150 such that the first knit layer 140 and the second knit layer 150 may be at least partially co-extensive. Further, the first knit layer 140 may overlay the second knit layer 150 such that the first knit layer 140 may form at least part of the outer-facing surface of the upper 110, and the second knit layer 150 may form at least part of the inner-facing surface of the upper.

The knitted component 130 may comprise a unitary knit construction and may be formed in a single knitting process. In other words, the first knit layer 140 and the second knit layer 150 may be integrated as a single piece during the knitting process. Additionally, examples of the knitted component 130 may be weft knit such that the first knit layer 140 and/or the second knit layer 150 may be formed on a weft-knitting machine, such as a flat v-bed knitting machine or a circular weft-knitting machine.

The first knit layer 140 may have a plurality of openings 160. The openings 160 extend through the first knit layer 140 and not the second knit layer 150. Therefore, portions of the second knit layer 150 are exposed through the openings 160 of the first knit layer 140, and those exposed portions of the second knit layer 150 may also form part of the outer-facing surface of the upper 110. These openings 160 are intentionally formed in the knitted process and may each extend a quantity of wales and a quantity of courses within the knitted component 130.

Looking now at FIGS. 1C-1F, example knit structures that can be associated with a knitted component, e.g., the knitted component 130, are shown, in accordance with aspects of the present disclosure. In particular, FIGS. 1C-1F illustrate example shapes that can be formed with the plurality of openings 160 through adjusting the knitting process. The shapes depicted in FIGS. 1C-1F can be incorporated into the various aspects described herein, e.g., into knitted components, uppers, and articles of footwear, among other things such as apparel and textiles. The example shapes of FIGS. 1C-1F include rounded-off edges. While the article of footwear 100 of FIGS. 1A and 1B is depicted as including openings with multiple shapes, e.g., similar to FIGS. 1C-1F, as the plurality of openings 160, this is for example purposes, and it is contemplated that a single shape or any combination of shapes may be present in the aspects described herein including articles of footwear. The same can be said for FIG. 2, discussed below, which depicts there being more than one shape for the plurality of openings 160 (e.g., multiple shapes are illustrated on a single knitted component in FIG. 2, but in connection with aspects herein, a single shape or other combinations of shapes may be used on or across a knitted component).

Returning to FIG. 1A, the first knit layer 140 may comprise a first yarn and the second knit layer 150 may comprise a second yarn. The first yarn and the second yarn may comprise elastane, as previously disclosed. Further, the first yarn and the second yarn may have different properties. In some aspects, the first and second yarns have different visual properties. For example, the first yarn and the second yarn may be different colors. The second yarn may generally be absent from the first knit layer 140, and in some aspects, the first yarn may generally be absent from the second knit layer 150. In this way, the openings 160 in the first knit layer 140 may have an effect of providing select visibility to the second yarn of the second knit layer 150, as that second yarn may be otherwise covered by the first knit layer 140. Alternatively or additionally, the first and second yarns may differ in other visual properties, such as size (e.g., diameter), pile, opacity, reflectivity, and the like. In some aspects, in addition to being a different color, the second yarn of the second knit layer 150 has a larger diameter than the first yarn of the first knit layer 140, which may provide more structure to the knitted component 130. As described further with respect to FIGS. 3-6B, the amount of the second knit layer 150 exposed through the openings 160 may change when tension is applied (i.e., the knitted component 130 is stretched), which may occur as a wearer is flexing a foot during certain movements and/or as a wearer's foot grows over time.

The first knit layer 140 and the second knit layer 150 may be integrally connected at one or more locations around each opening 160 and may be separable at one or more locations around each opening 160. In particular, one side of each opening 160 may be defined by a flap 162 of the first knit layer 140, where the first knit layer 140 is generally unsecured and separable from the second knit layer 150. Further details of the flap 162 are described with respect to FIGS. 3-5.

Examples of the knitted component 130 include apertures 170 extending through the thickness of the knitted component 130. For example, the apertures 170 are openings within the second knit layer 150 and, particularly, are within the portions of the second knit layer 150 that are exposed through openings 160 of the first knit layer 140. In this way, the apertures 170 extend through a single layer but may provide a passageway for fluid (e.g., air) through the knitted component 130 because the apertures 170 are included where the first knit layer 140 is absent (i.e., the openings 160). As such, the apertures 170 may enhance breathability of the upper 110.

The apertures 170 are integrally knitted apertures, as previously defined above. In example aspects, the apertures 170 each have a width of at least one wale and a height of at least one course. For example, each aperture 170 may have a width of one wale and a height of one course, which may be formed by a one-needle transfer. In another example, at least some of the apertures 170 have a width of two wales and a height of one course, which may be formed by a two-needle transfer.

Figure 2:
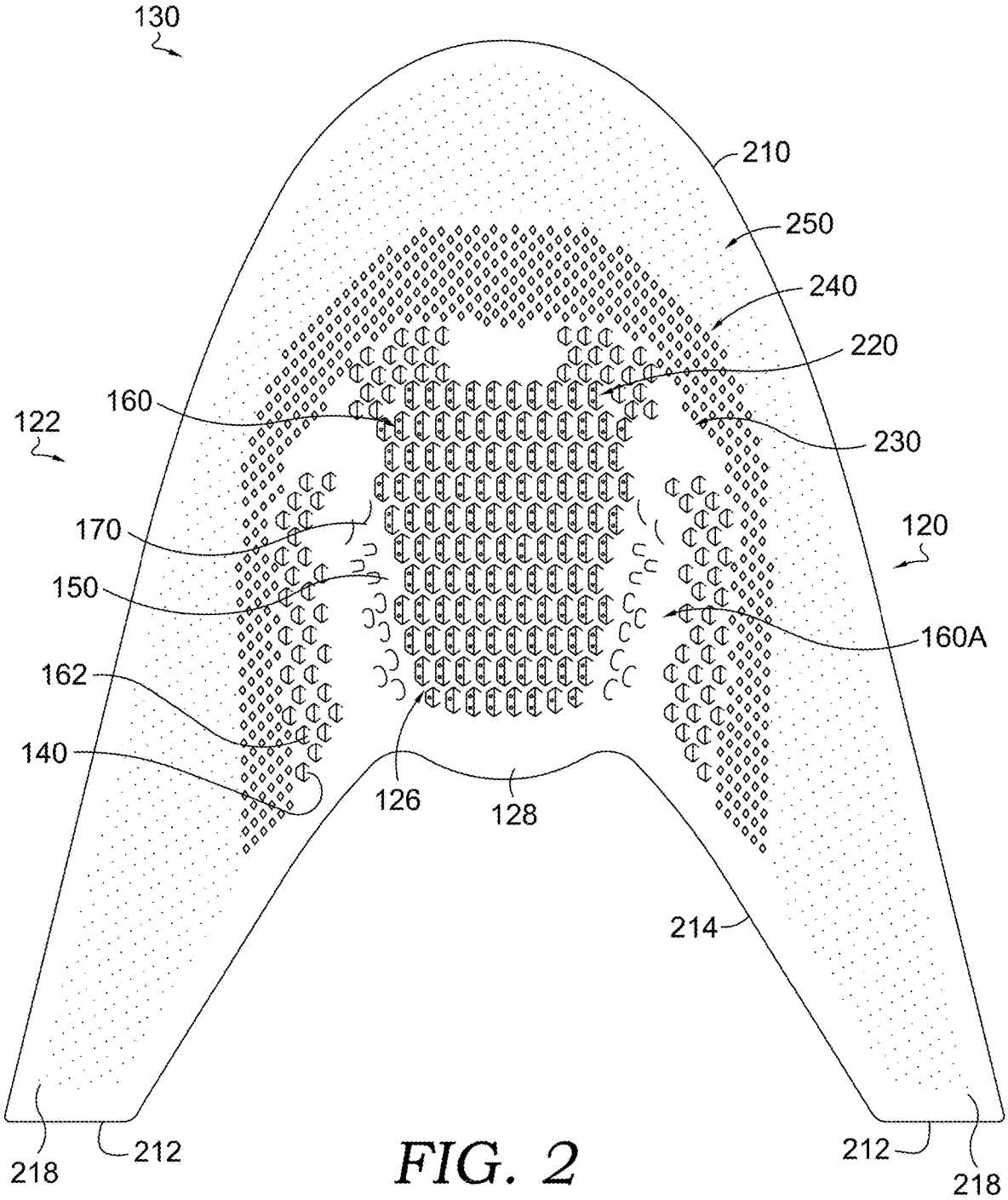
FIG. 2 illustrates a top view of a knitted component of the article of footwear of FIG. 1A in accordance with aspects herein.

FIG. 2 depicts the knitted component 130 in the shape of the upper 110 of FIGS. 1A-1B but in a generally flat configuration before being three-dimensionally shaped and secured to the sole structure 112. In example aspects, the knitted component 130 may have a generally U-shaped configuration that is outlined by an outer perimeter edge 210, a pair of heel edges 212, and an inner edge 214. The U-shaped configuration depicted in FIG. 2 is just one example shape of the knitted component 130, and other example shapes are contemplated herein.

When incorporated into the article of footwear 100, the outer perimeter edge 210 may be positioned against an upper surface of the sole structure 112 and may be joined to a strobel in example aspects. In other aspects, the upper 110 may include an underfoot portion also formed of the knitted component 130. In this example, the article of footwear 100 may not include a strobel. The knitted component 130 includes heel portion extensions 218 that each terminate at a heel edge 212. In example aspects, the heel portion extensions 218 overlap in the heel region 118 when the knitted component 130 is formed into the article of footwear 100. In particular, the heel portion extension 218 on the lateral side 120 may overlap the heel portion extension 218 on the medial side 122, and the two heel portion extensions 218 may be secured together in the overlapping configuration, as seen in FIG. 1B. In other examples, the pair of heel edges 212 are joined to each other to form a seam extending generally vertically in the heel region 118 of the article of footwear 100. The inner edge 214 of the knitted component 130 forms the ankle collar 124 and defines the tongue tab 128.

Some aspects of the knitted component 130 include variance in the size and/or shape of the openings 160 in the first knit layer 140 (as illustrated by exemplary FIGS. 1C-1F). Additionally or alternatively, there may be variance in the size and/or quantity of apertures 170 in the second knit layer 150. For example, the knitted component 130 includes a first zone 220 of openings 160 of a first size, and a second zone 230 with openings 160 of a second size that is smaller than the first size. The first and second sizes may be measured by a maximum width (e.g., see W1, W2, and W3 in FIG. 3 and further described herein) in the course-wise direction, where the maximum width is the width at the widest part of an opening 160. In one example, the openings 160 in the first zone 220 may have a maximum width of eight stitches, and the openings 160 in the second zone 230 may have a maximum width of four stitches. In some examples, the maximum width of the openings 160 decreases by half between adjacent zones (including the first zone 220, the second zone 230, and any other zones disclosed herein).

The first and second zones 220 and 230 may also vary in apertures 170. In various aspects, the first zone 220 includes a quantity of apertures 170 in the second knit layer 150 within each opening 160, and the second zone 230 includes less apertures 170 within each opening 160. In some examples, the second knit layer 150 includes no apertures within the second zone 230, while the second knit layer 150 includes at least one aperture per opening 160 in the first zone 220. All or a majority of the openings 160 in the first zone 220 may include two apertures 170. There may be some openings 160 in the first zone 220 that include one aperture 170 in the second knit layer 150. In some examples, the openings 160 with one aperture 170 form a transition between the openings 160 in the first zone 220 with multiple apertures 170 and openings 160 in the second zone 230 with no apertures 170. In some aspects, these transitional openings 160 (e.g., opening 160A) may also have a transitional size (e.g., the maximum width of the transitional opening 160 may be less than the maximum width of other openings 160 within the first zone 220 and greater than the maximum width of the openings 160 in the second zone 230).

In example aspects, the first zone 220 forms all or a majority of the throat region 126 of the knitted component 130. The second zone 230 may extend along a periphery of at least part of the first zone 220. For example, the second zone 230 may extend around the first zone 220 on all sides except adjacent the ankle collar 124. Because the openings 160 of the first zone 220 have more apertures 170 than those within the second zone 230, positioning the first zone 220 in the throat region 126 may provide increased breathability to the throat region 126 compared to other portions of the upper 110.

Some aspects of the knitted component 130 include a third zone 240 that includes openings 160 in the first knit layer 140 having a third size that is smaller than the second size. For example, where the maximum width of openings 160 within the second zone 230 may be four stitches, the maximum width of openings 160 within the third zone 240 may be two stitches. In various aspects, the third zone 240 does not include apertures within the second knit layer 150. In aspects where the second zone 230 does include aperture 170, the third zone 240 may include no apertures or fewer apertures per opening 160 than the second zone 230. The third zone 240 may be arranged along a periphery of at least part of the second zone 230. For example, the third zone 240 may extend around the second zone 230 on all sides except adjacent the ankle collar 124. The third zone 240 may be separated from the first zone 220 by the second zone 230.

Further, the knitted component 130 includes a fourth zone 250 in some aspects, where the fourth zone 250 includes openings 160 in the first knit layer 140 having a smaller size than the openings 160 in the third zone 240. For example, where the maximum width of openings 160 in the third zone 240 may be two stitches, the maximum width of openings 160 in the fourth zone 250 may be one stitch. In various aspects, the fourth zone 250 does not include apertures in the second knit layer 150. In aspects where the third zone 240 includes apertures 170, the fourth zone 250 may include no apertures or fewer apertures 170 per opening 160 than the third zone 240. The fourth zone 250 may be arranged along a periphery of at least part of the third zone 240. For example, the fourth zone 250 may extend around the third zone 240 on all sides except adjacent the ankle collar 124. The fourth zone 250 may be separated from the second zone 230 by the third zone 240. The fourth zone 250 may be adjacent the biteline 115 (see FIGS. 1A and 1B). Including smaller openings 160 at the biteline 115 and where the knitted component 130 may be secured to the sole structure 112 may help provide a smoother surface for securing the knitted component 130 to the sole structure 112 and enable a more secure attachment.

Figure 3:
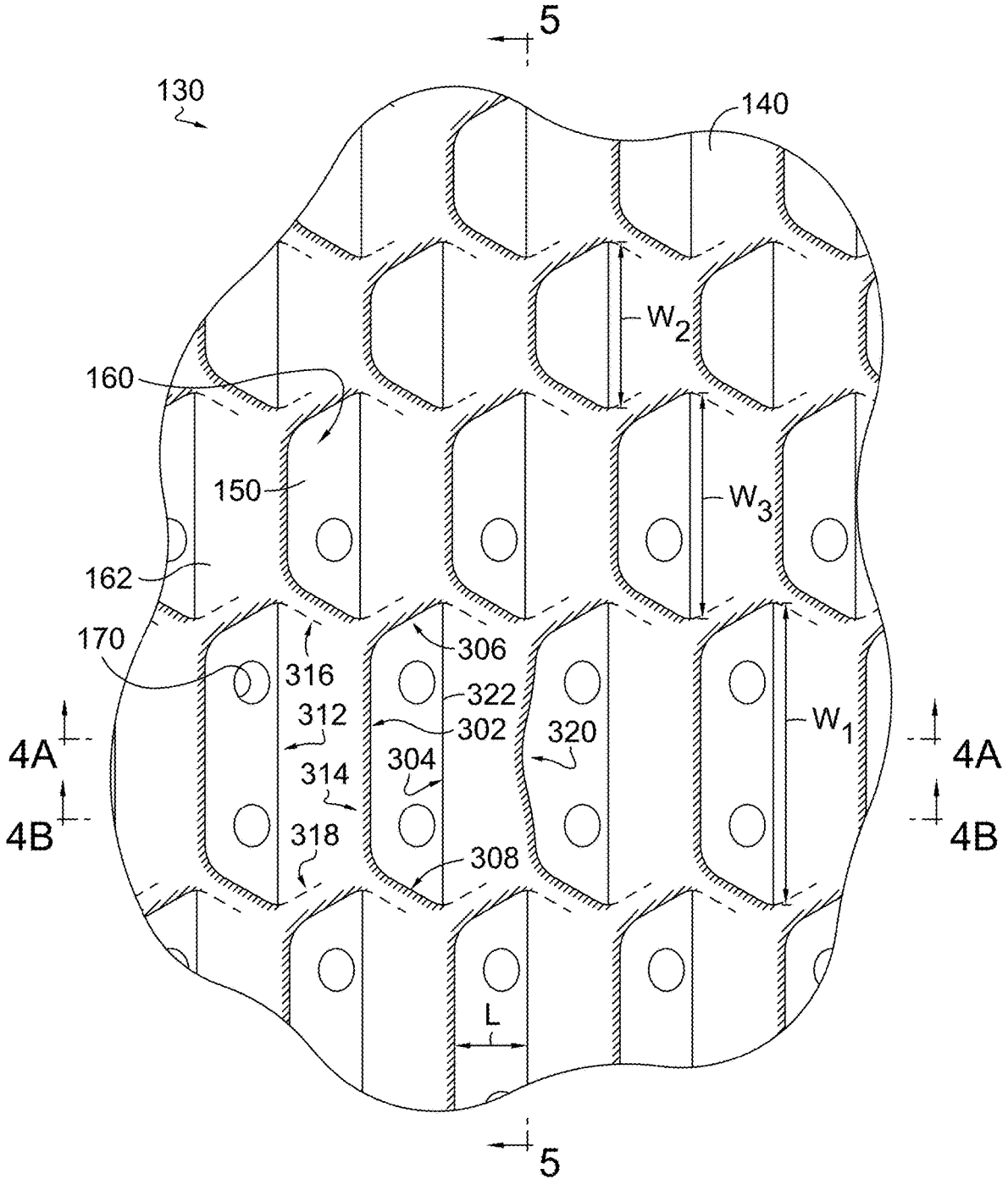
FIG. 3 illustrates a close-up view of a portion of the knitted component of FIG. 2 in accordance with aspects herein.

FIG. 3 depicts a close-up view of a portion of the knitted component 130. The openings 160 in the first knit layer 140 (exposing the second knit layer 150) and flaps of the first knit layer 140 overlaying the second knit layer 150 may be arranged in a staggered arrangement so that the openings 160 are not directly adjacent other openings 160 and the flaps 162 are not directly adjacent other flaps 162. Rather, each opening 160 may generally be surrounded by a plurality of flaps 162, and each flap 162 may be surrounded by a plurality of openings 160.

Each opening 160 within the first knit layer 140 generally has a first side 302, a second side 304 opposite the first side 302, a third side 306, and a fourth side 308 opposite the third side 306. At least the first side 302 of the opening 160 is defined by the first knit layer 140. Particularly, the first side 302 of the opening 160 may be an edge of a flap 162 of the first knit layer 140 where the first knit layer 140 is separable from the second knit layer 150. In some aspects, the third and fourth sides 306 and 308 of the opening 160 are defined by other flaps 162 within the first knit layer 140. Conversely, the second side 304 of the opening 160 may include an interconnected course portion 322, which is a portion of a knit course (i.e., a consecutive set of wales within a knit course) where yarn(s) of the first knit layer 140 is knit with yarn(s) of the second knit layer 150. In this way, the second side 304 of the opening 160 is not defined by two separable layers.

Similarly, each flap 162 may generally include a first side 312, a second side 314 opposite the first side 312, a third side 316, and a fourth side 318 opposite the third side 316. At least the second side 314 of the flap 162 is an edge that is unsecured to the first knit layer 140. Conversely, the first side 312 of the flap 162 may be the interconnected course portion 322 where yarns of the first and second knit layers are interconnected so that there are not two separable layers, as described further herein.

In various aspects, the first knit layer 140 may be unsecured from the second knit layer 150 along the entire length L of the flap 162 between the first side 312 and the second side 314. In this way, a pocket 320 may be formed between the first knit layer 140 and the second knit layer 150 where the two layers are unsecured to each other. The pocket 320 may represent an actual space between the first and second knit layers 140 and 150 or a potential space, where the first and second knit layers 140 and 150 may be contacting each other but are unsecured so that a space may be created when the first and second knit layers 140 and 150 are pulled apart. FIG. 3 shows a portion of the first knit layer 140 being slightly separated from the second knit layer 150 to reveal part of the pocket 320. Because the edge on the second side 314 of the flap 162 remains unsecured to the second knit layer 150, the pocket 320 between the first and second knit layers 140 and 150 may extend continuously into the opening 160 formed within the first knit layer 140.

In some aspects, the third side 316 and the fourth side 318 of the flap 162 of the first knit layer 140 are also unsecured from and overlaying the second knit layer 150. In this way, each flap 162 may be generally unsecured from the second knit layer 150 except at the interconnected course portion 322.

In various examples, the interconnected course portion 322 has a single-layered knit construction with yarns of the first and second knit layers 140 and 150 being knit together within the same course using a single needle bed. This construction may include alternating looping yarn used for the first knit layer 140 and yarn used for the second knit layer 150 on a set of consecutive needles on a single bed to form the interconnected course portion 322. In some examples, the flap 162 of the first knit layer 140 and underlying second knit layer 150 may be formed by knitting a first yarn of the first knit layer 140 on a first needle bed (e.g., front needle bed) while a second yarn of the second knit layer 150 is knit on a second needle bed (e.g., back needle bed) for a plurality of courses across a set of wales. The first yarn of the first knit layer 140 may then be transferred to the second needle bed, and the first and second yarns may both be knit on the second needle bed across the set of wales for at least one course to form the interconnected course portion 322. After the interconnected course portion 322 is formed, only the second yarn of the second knit layer 150 may be knit for a plurality of courses over the same set of wales, which knits a portion of the second knit layer 150 while leaving an opening 160 in the first knit layer 140. Additionally, while the second yarn is knit by itself, the second yarn may be transferred to adjacent needles on the same bed to form one or more apertures 170.

Alternatively, the interconnected course portion 322 may include forming loops of yarn from both knit layers 140 and 150 on at least some of the same needles within the set of consecutive needles on a single needle bed. Further, instead of the interconnected course portion 322 having a single knit construction, some aspects include the interconnected course portion 322 having a double knit construction, where the first and the second knit layers are integrally joined and not separable, either by a yarn from the first knit layer 140 being transferred across needle beds to knit with the second knit layer 150 and vice versa, or from another yarn being knit into both layers.

The openings 160 of the first knit layer 140 may take various shapes in different aspects. In the example shown in FIG. 3, the openings 160 have a trapezoidal shape, where the first side 302 of the opening 160 has a shorter width than the second side 304. The second side 304, which is defined by the interconnected course portion 322, may define the maximum width for the opening 160. The sample portion depicted in FIG. 3 shows various maximum widths as described with respect to FIG. 2. For example, the first maximum width W1 may be the maximum width of openings within the first zone 220 in FIG. 2, and the second maximum width W2 may be the maximum width of openings 160 within the second zone 230 in FIG. 2. Further, there may be some transitional openings 160 having a maximum width W3 that is shorter than W1 and longer than W2. In one example, W1 is approximately eight knit stitches (eight wales), W2 is approximately four stitches (four wales), and W3 is approximately six stitches (six wales). It is contemplated that other widths may be present in other examples. Further, there may be different shapes, including other polygonal and quadrilateral shapes of the openings 160 in other examples.

Figure 4A:
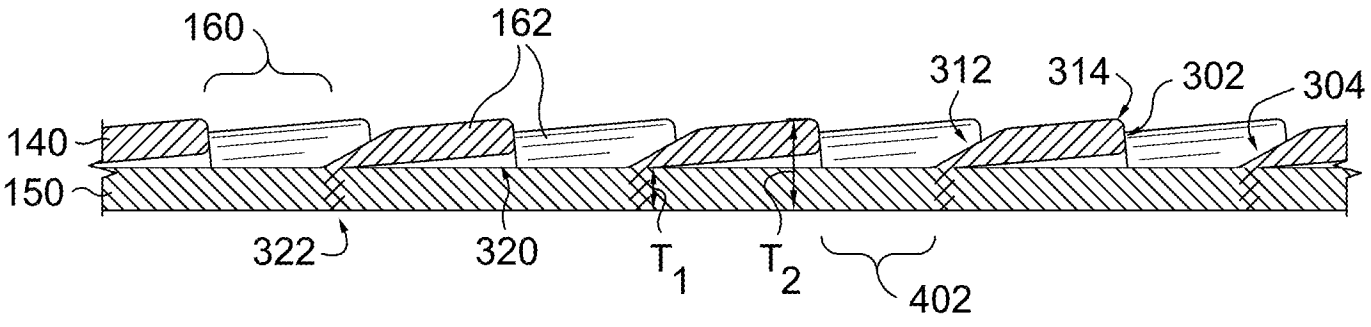
FIGS. 4A and 4B illustrate schematic cross-sectional views of the portion of the knitted component taken at cut lines 4A-4A and 4B-4B, respectively, in FIG. 3 in accordance with aspects herein.
Figure 4B:
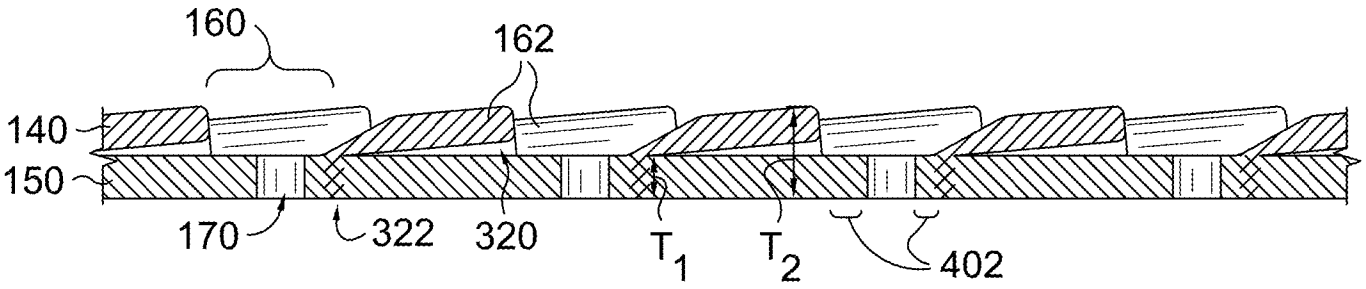

FIGS. 4A and 4B depict schematic cross-sectional views taken at cutline 4A-4A and cutline 4B-4B, respectively, in FIG. 3. Each of these cross-sectional views extends in a wale-wise direction of the knitted component 130 and extends through multiple openings 160 and flaps 162 of the first knit layer 140. The view of FIG. 4A is taken along a wale positioned between apertures 170 in the second knit layer 150, while the view of FIG. 4B is taken along a wale having apertures 170.

FIGS. 4A and 4B both depict the first knit layer 140 forming flaps 162 overlaying the second knit layer 150, where the flaps 162 are separated by openings 160 within the first knit layer 140. For purposes of illustration, the flaps 162 of the first knit layer 140 are shown as having some separation from the second knit layer 150 to schematically represent the pocket 320 between the first and second knit layers 140 and 150; however, it should be understood that the first knit layer 140 may maintain contact with the second knit layer 150 even where they are separable.

The openings 160 expose portions of the second knit layer 150 so that these exposed portions 402 of the second knit layer 150 may be visible on the outer side of the article of footwear 100 while other portions of the second knit layer 150 are covered by the first knit layer 140 and, therefore, not visible on the outer side. In various examples, the first knit layer 140 includes a first yarn, and the second knit layer 150 includes a second yarn with a different property, such as a different color, than the first yarn. In some aspects, the second yarn is absent from at least the flaps 162 of the first knit layer 140 and/or the first yarn is absent from at least the exposed portions 402 of the second knit layer 150. In this way, the openings 160 provide a different visual effect through exposing the second yarn of the second knit layer 150. In other aspects, the flaps 162 of the first knit layer 140 and the exposed portions 402 of the second knit layer 150 may have one or more yarns in common but may have different concentrations of the common yarn so that the flaps 162 and the exposed portions 402 still provide overall different visual effects.

FIGS. 4A and 4B also illustrate how the first side 312 of each flap 162 of the first knit layer 140 is defined by the interconnected course portion 322, and the second side 314 of each flap 162 forms an edge of the first knit layer 140 defining the first side 302 of the opening 160. The second side 314 of the flap 162 of the first knit layer 140 may be separable from the second knit layer 150 such that the pocket 320 between the first and second knit layers 140 and 150 may continuously extend to the opening 160.

Figure 5:
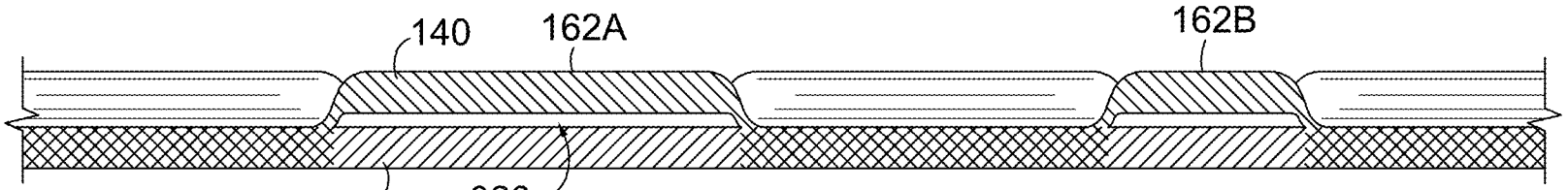
FIG. 5 illustrates a schematic cross-sectional view of the portion of the knitted component taken at cutline 5-5 in FIG. 3 in accordance with aspects herein.

In various aspects, the interconnected course portion 322 may have a single layer knit construction where yarn from the first knit layer 140 (e.g., the first yarn) is knit with yarn of the second knit layer (e.g., the second yarn) within a set of wales in a single course. In other aspects, the knitted component 130 may still have a double-layered knit construction at the interconnected course portion 322, where the first and second knit layers 140 and 150 are present but include one or more interlayer stitches to keep the two knit layers inseparable at the interconnected course portion 322. FIGS. 4A and 4B, as well as FIG. 5, represent the joining of yarns from the first knit layer 140 and the second knit layer 150 by mixing the hatch markings at the interconnected course portion 322.

In various aspects, each interconnected course portion 322 is a single course with a quantity of knit stitches (corresponding to wales) across the opening 160. In other aspects, each interconnected course portion 322 has multiple courses of either a single-layered knit construction or an inseparable double-layered knit construction.

It will be appreciated that, in aspects with a single-layered interconnected course portion 322, the thickness ($T_1$) of the knitted component 130 at the interconnected course portion 322 may be smaller than the thickness ($T_2$) at the second side 314 of the flap 162, where the first knit layer 140 overlays the second knit layer 150. In some aspects, the second side 314 of the flap 162 may curl upwards, further increasing the thickness ($T_2$) at the second side 314 relative to the interconnected course portion 322. As such, in some aspects, the knitted component 130 has different thicknesses on opposite sides of each opening 160 (e.g., the thickness $T_1$ of the knitted component 130 defining the second side 304 of the opening 160 is less than the thickness $T_2$ of the knitted component 130 defining the first side 302 of the opening 160). The asymmetrical thickness around the opening 160 may create variance in the visual effect of the opening 160 dependent on which side of the opening 160 a viewing angle is located. In other words, someone positioned on the second side 304 of an opening 160 may be able to see more of the exposed portion 402 of the second knit layer 150 through the opening 160 than someone positioned on the first side 302 of the opening 160 because the greater thickness of the knitted component 130 on the first side 302 of the opening 160 may at least partially block the exposed portion 402. Although various examples described herein have included the first side 302 of the opening 160 being defined by separable portions of the first and second knit layers 140 and 150, it should be understood that other aspects include the first side 302 being defined by the first knit layer 140 overlaying the second knit layer 150 in a way such that the first knit layer 140 is inseparable form the second knit layer 150, while the second side 304 of the opening 160 is defined by a single-layered portion (e.g., single-layered interconnected course portion 322) of the knitted component 130. This configuration may still result in the knitted component 130 having a greater thickness at the first side 302 of the opening 160 than the knitted component 130 at the second side 304 of the opening 160 and, therefore, may create variance in the visibility of the exposed portion 402 of the second knit layer 150 dependent on the viewing angle.

FIGS. 4A and 4B also depict the staggered arrangement of the flaps 162. The flaps 162 that are shown in hatch marks in FIGS. 4A and 4B have a common set of wales, and they are staggered relative to an adjacent group of flaps 162 formed with a different set of wales. In this way, there are flaps 162 from an adjacent set of wales that align with the openings 160 visible in FIGS. 4A and 4B. Similarly, it will be appreciated, particularly as shown in FIG. 3, that the openings 160 within the first knit layer 140 and the exposed portions 402 of the second knit layer 150 are similarly staggered across adjacent sets of wales.

FIG. 4B is similar to FIG. 4A but shows a cross-sectional view taken along a wale within FIG. 3 that extends through the apertures 170. As such, FIG. 4B depicts apertures 170 in the exposed portions 402 of the second knit layer 150.

FIG. 5 depicts a schematic cross-sectional view taken at cutline 5 in FIG. 3. The cross-sectional view extends in a course-wise direction along a knit course that includes interconnected course portions 322. The interconnected course portions 322, which may be single-layered knit constructions, are separated from each other by double-layered portions of the knitted component 130, where the first knit layer 140 overlays and is separable from the second knit layer 150 forming the pocket 320 between the two layers 140 and 150. FIG. 5 also shows how the size of the flaps 162 of the first knit layer 140 may be varied. For example, the width of the flap 162A is greater than the width of the flap 162B in FIG. 5, which may also correspond with a change in the width of the openings 160, as previously described with respect to FIGS. 2 and 3.

Figure 6A:
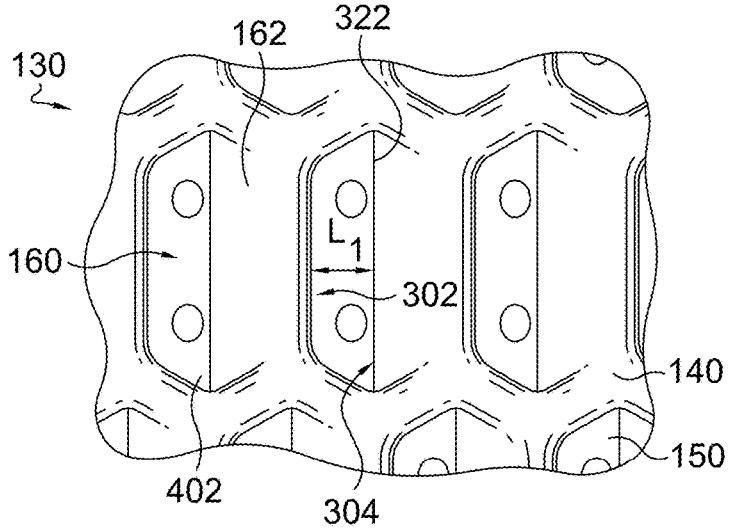
FIGS. 6A and 6B illustrate a portion of the knitted component of FIG. 3 in an un-stretched condition and in a stretched condition, respectively, in accordance with aspects herein.
Figure 6B:
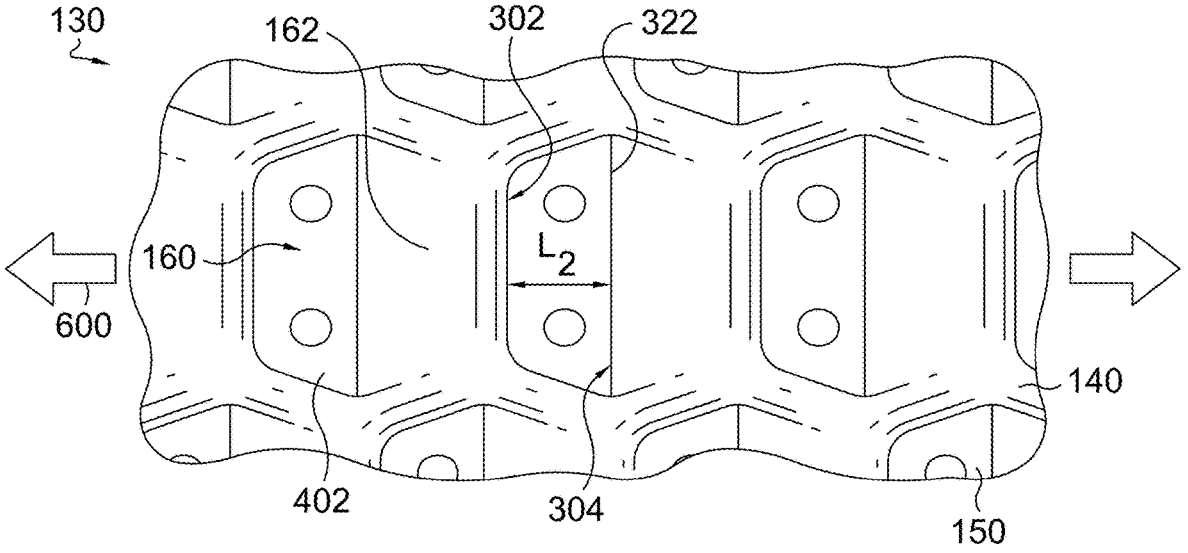

FIGS. 6A and 6B illustrate how the visual effect of the knitted component 130 may change when tension is applied. FIG. 6A depicts a portion of the knitted component 130 in an un-stretched (or neutral) condition, and FIG. 6B depicts the portion of the knitted component 130 in a stretched condition. In the un-stretched state of FIG. 6A, the exposed portion 402 of the second knit layer 150 includes a length $L_1$ spanning between the first side 302 and the second side 304 of an opening 160 through which the exposed portion 402 is visible. As the knitted component 130 stretches as shown in FIG. 6B, the exposed portion 402 has a greater length $L_2$ that is visible through the opening 160. In other words, more of the second knit layer 150 becomes exposed through the openings 160 when the knitted component 130 is stretched. Because the flap 162 of the first knit layer 140 is secured via the interconnected course portion 322 on one side but unsecured on the opposite side, the length of the flap 162 of the first knit layer 140 that is overlaying the second knit layer 150 does not stretch at all or stretches to a lesser extent than the second knit layer 150. Because the exposed portion 402 of the second knit layer 150 provides a different visual effect than the first knit layer 140, stretching of the knitted component 130 may change visual impact of the second knit layer 150 to a greater extent than stretching impacts the visual effect from the first knit layer 140.

The direction of stretch shown by arrows 600 in FIG. 6B may correspond to a wale-wise direction. When the knitted component 130 is incorporated into an article footwear, as shown in FIGS. 1A and 1B, the direction of stretch 600 may correspond to a lateral-medial direction across the article of footwear. As a foot becomes swollen, such as during longer periods of physical activity or during pregnancy, the change in foot size often causes stretching in the lateral-medial direction and, therefore, may create a similar type of stretch shown in FIG. 6B. In this way, the change in the visual effect of the knitted component 130 may change during pregnancy, or other conditions relating to changing foot size. This change in the visual effect due to stretching as shown in FIG. 6B may also occur during certain movements with a more discrete period of time, such as when a wearer flexes their foot.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are examples and are not limiting.

Clause 1: A knitted component comprising: a first knit layer and a second knit layer, wherein the first knit layer includes a plurality of openings through which portions of the second knit layer are exposed, wherein a first side of each opening extends along a plurality of wales and is adjacent a pocket formed between the first knit layer and the second knit layer, wherein the pocket extends continuously into the opening.

Clause 2: The knitted component of clause 1, wherein the knitted component, at a second side of each opening opposite the first side, comprises at least one course of a single knit layer with yarns of the first knit layer and the second knit layer knit together.

Clause 3: The knitted component of any of clauses 1-2, wherein each opening includes a third side and a fourth side opposite the third side, wherein the first knit layer overlays and is separable from the second knit layer at the first side, the third side, and the fourth side of the opening.

Clause 4: The knitted component of any of clauses 1-3, wherein the plurality of openings are arranged in a staggered pattern.

Clause 5: The knitted component of any of clauses 1-4, wherein the first knit layer comprises a first yarn having elastane and the second knit layer comprises a second yarn having elastane.

Clause 6: The knitted component of any of clauses 1-5, wherein the second yarn has a greater diameter than the first yarn.

Clause 7: The knitted component of any of clauses 1-6, wherein the plurality of openings have different sizes.

Clause 8: An article of footwear comprising an upper comprising the knitted component of any of clauses 1-7.

Clause 9: The article of footwear of clause 8, wherein at least some of the plurality of openings extend over a throat region of the upper.

Clause 10: The article of footwear of any of clauses 8-9, wherein the first side of each opening extends in a toe-heel direction.

Clause 11: The article of footwear of any of clauses 8-10, wherein a first portion of the plurality of openings are within a throat region of the upper and a second portion of the plurality of openings are between the throat region and a biteline, wherein the openings within the first portion have a larger size than the openings within the second portion.

Clause 12: A knitted component comprising: a first knit layer and a second knit layer, wherein the first knit layer includes a plurality of openings that expose portions of the second knit layer, wherein exposed portions of the second knit layer include one or more apertures each extending at least one wale and having a height of at least one course.

Clause 13: The knitted component of clause 12, wherein at least some of the exposed portions of the second knit layer exposed each include two apertures.

Clause 14: The knitted component of any of clauses 12-13, wherein the number of apertures in each exposed portion of the second knit layer varies.

Clause 15: The knitted component of any of clauses 12-14, wherein the first knit layer includes a second plurality of openings that expose portions of the second knit layer that do not include apertures.

Clause 16: An article of footwear comprising an upper comprising the knitted component of any of clauses 12-15.

Clause 17: The article of footwear of clause 16, wherein the plurality of openings extend within a throat region of the upper.

Clause 18: A knitted component comprising: a first knit layer and a second knit layer integrally knit with the first knit layer, the first knit layer comprising a first yarn having a first property and the second knit layer comprising a second yarn having a second property that is different than the first property, wherein the first knit layer includes a plurality of openings through which portions of the second knit layer are exposed, wherein the knitted component is configured to stretch from an un-stretched condition to a stretched condition, wherein when the knitted component is stretched from the un-stretched condition to the stretched condition, additional portions of the second knit layer that were covered by the first knit layer in the un-stretched condition are exposed through the plurality of openings.

Clause 19: The knitted component of clause 18, wherein the first property is a first color and the second property is a second color.

Clause 20: The knitted component of any of clauses 18-19, wherein the first yarn is absent from the second knit layer and the second yarn is absent from the second knit layer.

Clause 21: The knitted component of any of clauses 18-20, wherein each opening includes a first side and a second side opposite the first side, wherein the knitted component at the first side of each opening has a greater thickness than the knitted component at the second side of each opening.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present disclosure.

It will be understood that certain features and subcombinations are of utility and may be employed without reference to other features and subcombinations and are contemplated within the scope of the claims. Not all steps listed in the various figures need be carried out in the specific order described.

What is claimed is:

1. A knitted component comprising:

a first knit layer and a second knit layer, wherein the first knit layer includes a plurality of openings through which portions of the second knit layer are exposed, wherein a first side of each opening extends along a plurality of wales and is adjacent a pocket formed between the first knit layer and the second knit layer, wherein the pocket extends continuously into the opening, wherein the knitted component, at a second side of each opening opposite the first side, comprises at least one course of a single layer with yarns of the first knit layer and the second knit layer knit together, and wherein the first and second knit layers are integrally joined along the second side and unsecured on the first side.

2. The knitted component of claim 1, wherein each opening includes a third side and a fourth side opposite the third side, wherein the first knit layer overlays and is separable from the second knit layer at the first side, the third side, and the fourth side of the opening.

3. The knitted component of claim 1, wherein the plurality of openings are arranged in a staggered pattern.

4. The knitted component of claim 1, wherein the first knit layer comprises a first yarn having elastane and the second knit layer comprises a second yarn having elastane.

5. The knitted component of claim 4, wherein the second yarn has a greater diameter than the first yarn.

6. The knitted component of claim 1, wherein the plurality of openings have different sizes.

7. An article of footwear comprising an upper comprising the knitted component of claim 1.

8. The article of footwear of claim 7, wherein at least some of the plurality of openings extend over a throat region of the upper.

9. The article of footwear of claim 7, wherein the first side of each opening extends in a toe-heel direction.

10. The article of footwear of claim 7, wherein a first portion of the plurality of openings are within a throat region of the upper and a second portion of the plurality of openings are between the throat region and a biteline, wherein the openings within the first portion have a larger size than the openings within the second portion.

11. A knitted component comprising:

a first knit layer and a second knit layer, wherein the first knit layer includes a plurality of openings that expose portions of the second knit layer, wherein a first side of each opening extends along a plurality of wales and is adjacent a pocket formed between the first knit layer and the second knit layer, wherein the pocket extends continuously into the opening, wherein the first knit layer and the second knit layer are integrally joined along a second side of each opening opposite the first side and unsecured along the first side, and wherein exposed portions of the second knit layer include one or more apertures each extending at least one wale and having a height of at least one course.

12. The knitted component of claim 11, wherein at least some of the exposed portions of the second knit layer exposed each include two apertures.

13. The knitted component of claim 12, wherein the number of apertures in each exposed portion of the second knit layer varies.

14. The knitted component of claim 11, wherein the first knit layer includes a second plurality of openings that expose portions of the second knit layer that do not include apertures.

15. An article of footwear comprising an upper comprising the knitted component of claim 11.

16. The article of footwear of claim 15, wherein the plurality of openings extend within a throat region of the upper.

17. A knitted component comprising:

a first knit layer and a second knit layer integrally knit with the first knit layer, the first knit layer comprising a first yarn having a first property and the second knit layer comprising a second yarn having a second property that is different than the first property, wherein the first knit layer includes a plurality of openings through which portions of the second knit layer are exposed, wherein, for each opening, the first knit layer and the second knit layer are integrally joined along a first side of the opening and are unsecured along an opposing second side of the opening, and wherein the knitted component is configured to stretch from an un-stretched condition to a stretched condition, wherein when the knitted component is stretched from the un-stretched condition to the stretched condition, additional portions of the second knit layer that were covered by the first knit layer in the un-stretched condition are exposed through the plurality of openings.

18. The knitted component of claim 17, wherein the first property is a first color and the second property is a second color.

19. The knitted component of claim 17, wherein the first yarn is absent from the second knit layer and the second yarn is absent from the second knit layer.

20. The knitted component of claim 17, wherein each opening includes a first side and a second side opposite the first side, wherein the knitted component at the first side of each opening has a greater thickness than the knitted component at the second side of each opening.

21. A knitted component comprising:

a first knit layer and a second knit layer, wherein the first knit layer includes a plurality of openings through which portions of the second knit layer are exposed, wherein a first side of each opening extends along a plurality of wales and is adjacent a pocket formed between the first knit layer and the second knit layer, wherein the pocket extends continuously into the opening, wherein the knitted component, at a second side of each opening opposite the first side, comprises at least one course of a single layer with yarns of the first knit layer and the second knit layer knit together, wherein the first and second knit layers are integrally joined along the second side and unsecured on the first side, and wherein each opening includes a third side and a fourth side opposite the third side, wherein the first knit layer overlays and is separable from the second knit layer at the first side, the third side, and the fourth side of the opening.

* * * * *